United States Patent [19]

Hook

[11] 4,011,111

[45] Mar. 8, 1977

[54] HIGH STRENGTH, DEEP DRAWING QUALITY, LOW CARBON STEEL, ARTICLE FORMED THEREFROM, AND METHOD FOR PRODUCTION THEREOF

[75] Inventor: Rollin E. Hook, Dayton, Ohio

[73] Assignee: Armco Steel Corporation, Middletown, Ohio

[22] Filed: Aug. 25, 1975

[21] Appl. No.: 607,624

[52] U.S. Cl. ..... 148/16.6; 148/12.1; 148/16.0; 148/36

[51] Int. Cl.[2] ..... C21D 1/48

[58] Field of Search ..... 148/16, 16.5, 16.6, 148/20.3, 12.1, 36

[56] References Cited

UNITED STATES PATENTS

| | | | |
|---|---|---|---|
| 2,437,249 | 3/1948 | Floe | 148/16.6 |
| 3,262,821 | 7/1966 | Yoshida | 148/12.1 |
| 3,303,060 | 2/1967 | Shimizu et al. | 148/12.1 |
| 3,399,085 | 8/1968 | Knechtel et al. | 148/16.6 |
| 3,765,874 | 10/1973 | Elias et al. | 148/36 |
| 3,847,682 | 11/1974 | Hook | 148/12.1 |
| 3,892,597 | 7/1975 | Lincoln et al. | 148/16.6 |

*Primary Examiner*—Walter R. Satterfield
*Attorney, Agent, or Firm*—Melville, Strasser, Foster & Hoffman

[57] ABSTRACT

Deep drawing quality, low carbon steel is strengthened by alloy-nitrogen precipitation strengthening. A deoxidized, low carbon steel sheet or strip stock, or article formed therefrom, containing from about 0.02% to 0.2% titanium in solution, from about 0.025% to 0.3% columbium in solution, from about 0.025% to 0.3% zirconium in solution, singly or in admixture, is heat treated at 1100° to 1300° F (593° to 705° C) in an atmosphere containing 1% to 20% by volume ammonia for a time sufficient to produce an iron nitride surface layer, and then denitrided in a hydrogen-nitrogen atmosphere containing 6% to 50% hydrogen by volume at 1200° to 1400° F (649° to 760° C) for a time sufficient to remove the iron nitride surface layer and to reduce nitrogen in solid solution to less than 0.03% by weight.

11 Claims, No Drawings

HIGH STRENGTH, DEEP DRAWING QUALITY, LOW CARBON STEEL, ARTICLE FORMED THEREFROM, AND METHOD FOR PRODUCTION THEREOF

BACKGROUND OF THE INVENTION

1. Field of the Invention:

The present invention relates to a method of strengthening low carbon steel cold rolled strip and sheet stock and articles formed therefrom. In particular, a preferred embodiment of this invention involves the concept of producing stamped or deep drawn parts from a low strength, deep drawing-quality steel, and subsequently strengthening the parts by alloy-nitrogen precipitation strengthening. In another embodiment cold rolled and annealed sheet and strip stock can be strengthened by alloy-nitrogen precipitation strengthening before forming to obtain higher yield strength than has hitherto been available in low carbon steel while at the same time producing very high average plastic strain ratios, $r_m$ values.

Prior art high strength, cold rolled sheet stock has exhibited $r_m$ values of about 1.0 to 1.2. The present invention attains very high plastic strain ratios ($r_m$ values ranging from about 1.8 to about 2.2), together with yield strengths up to 90 ksi or higher.

2. Description of the Prior Art:

U.S. Pat. No. 3,847,682, issued Nov. 12, 1974 to Rollin E. Hook, discloses a method of increasing the yield strength of a low carbon steel sheet stock or an article formed therefrom by heating in an atmosphere comprising ammonia and hydrogen. A deoxidized, low carbon steel containing from about 0.002% to about 0.015% carbon, up to about 0.012% nitrogen, up to about 0.08% aluminum, a nitrogen-forming element chosen from the group consisting of titanium, columbium, zirconium, and mixtures thereof, in amounts such that titanium in solution is from about 0.02% to about 0.2%, columbium in solution is from about 0.025% to about 0.3%, and zirconium in solution is from about 0.025% to about 0.3%, and balance essentially iron, is heat treated at 1100° to 1350° F in an atmosphere containing ammonia in an amount insufficient, at the temperature and time involved, to permit formation of iron nitride, Within a preferred temperature range of 1100° to 1300° F the preferred furnace atmosphere comprises ammonia-hydrogen mixtures having 3% to 6% by volume ammonia. The maximum ammonia concentrations which can be used within this temperature range and which avoid the formation of an iron nitride surface layer are as follows:

1100° F — about 10% ammonia,
1200° F — about 6% ammonia,
1300° F — about 3% ammonia.

This patent further discloses that nitrogen taken into solid solution as a result of the alloy-nitrogen precipitation strengthening step can present weldability problems and can result in high ductile-to-brittle Charpy impact transition temperatures. However, if the nitriding step is followed by a denitriding step which involves annealing in pure hydrogen at about 1200° F for at least two hours, the excess nitrogen is removed (with only a 10–20% reduction in yield strength), thereby eliminating welding porosity and substantially reducing the ductile-to-brittle transition temperature with consequent improvement in Charpy impact energy values.

Case hardening by heat treating in an ammonia containing atmosphere to form an iron-nitrogen austenitic structure which is transformed by quenching to a martensitic structure having high surface hardness, has been practiced for many years, and a typical process relating to nitriding of a "Nitralloy" type steel is disclosed in U.S. Pat. No. 3,399,085, issued Aug. 27, 1968 to H. E. Knechtel et al.

U.S. Pat. No. 3,215,567, issued Nov. 2, 1965 to H. Yoshida; U.S. Pat. No. 3,281,286, issued Oct. 25, 1966 to M. Shimizu et al; and U.S. Pat. No. 3,303,060, issued Feb. 7, 1967 to M. Shimizu et al, disclose denitriding and decarburizing of cold-rolled low carbon steel sheet and strip stock. When denitriding is desired in these prior art processes, an atmosphere containing in excess of 70% by volume hydrogen is used (derived from AX or HNX gas) at temperatures ranging from about 600° to about 750° C.

While the above-mentioned U.S. Pat. No. 3,847,682 thus provides a method of strengthening low carbon steel strip or sheet, or articles formed therefrom by stamping or deep drawing, for optimum weldability and Charpy impact properties, the product requires denitriding after the alloy-nitrogen precipitation strengthening step. According to the prior art denitriding must be conducted in an atmosphere containing more than about 70% hydrogen at temperatures of about 600° to about 750° C, for periods of time ranging up to 40 hours. It is thus evident that such a denitriding step is expensive, commercially impractical and dangerous by reason of the high hydrogen content of the annealing atmosphere.

SUMMARY

It is a principal object of the present invention to provide a process for strengthening cold rolled sheet or strip stock, or articles formed therefrom, by a nitriding treatment, followed by a denitriding treatment, which method is economical, commercially feasible and safe.

It is a further object of the invention to provide a cold rolled sheet or strip stock, and a method for production thereof, in the thickness range of 0.02 to 0.09 inch, having a yield strength ranging from about 50 to about 100 ksi and very high average plastic strain ratios ($r_m$ values of about 1.8 to about 2.2).

A composition suitable for the practice of the present invention comprises, by weight percent:

| | |
|---|---|
| carbon | about 0.002% – 0.015% |
| nitrogen | up to about 0.012% |
| aluminum | up to about 0.08% |
| manganese | about 0.05% – 0.6% |
| sulfur | up to about 0.035% |
| oxygen | up to about 0.01% |
| phosphorus | up to about 0.01% |
| silicon | up to about 0.015% |
| at least one of | |
| titanium | about 0.02% – 0.2% in solution |
| columbium | about 0.025% – 0.3% in solution |
| and | |
| zirconium | about 0.025% – 0.3% in solution |
| iron | remainder, except for incidental impurities. |

In the above broad composition range, the titanium, columbium and zirconium may be present singly or in admixture, the sum total of these elements not exceeding about 0.3% in solution.

According to the present invention, a method of increasing the yield strength of a vacuum decarburized and deoxdized low carbon steel within the composition ranges set forth above comprises casting the molten steel into ingots or continuously casting to slab form, hot rolling to strip thickness. If an article is to be formed therefrom, the cold rolled strip or sheet is annealed to obtain a fully recrystallized, ductile deep-drawing steel.

The strengthening treatment for formed articles comprises placing the articles in an annealing furnace provided with means to seal the furnace to prevent escape of gases or contact with air, bringing the articles to a temperature between 1100° and 1300° F (593° to 705° C) while in a protective atmosphere comprising a hydrogen-nitrogen mixture ranging from 6% to 20% hydrogen by volume. Upon reaching the desired treatment temperature, ammonia is introduced into the atmosphere in amounts such that the ammonia content ranges from about 1% to about 20% by volume. The treatment time is dependent upon the thickness of the steel and is sufficient to cause reaction of all the nitride-forming elements in the steel with the nitrogen provided by the ammonia gas to form small, uniformly dispersed nitrides. The nitriding treatment is concluded by discontinuing the introduction of ammonia, which results in flushing it from the furnace naturally. The anneal is then continued in the form of a denitriding treatment in a hydrogen-nitrogen mixture containing from about 6% to about 50% hydrogen by volume, within the temperature range of 1200° to 1400° F (649° to 760° C) for a period of time (generally equal to or shorter than the duration of the nitriding step) sufficient to remove the iron-nitride surface layer which has been formed on the steel. Preferably, nitrogen in solid solution is reduced to less than about 0.03% by weight.

When high strength strip or sheet stock (having high $r_m$ ) values) is to be produced, the cold rolled strip is open-coil annealed, to produce a fully recrystallized structure, in a hydrogen-nitrogen furnace atmosphere usually containing about 6% to about 20% hydrogen by volume. Annealing in the temperature range of about 1300° – 1400° F (705° – 760° C) for four or more hours is usually sufficient to accomplish 100% recrystallization. If a high $r_m$ value is to be developed simultaneously with high strength, it is essential that the steel be 100% recrystallized prior to the alloy-nitrogen strengthening step. The alloy-nitrogen strengthening treatment preferably is then performed as a step subsequent to recrystallization in the same annealing cycle, since open coil annealing allows free circulation of the nitriding atmosphere between the laps of the coil. The temperature is adjusted to a desired value in the range of 1100° to 1300° F (593° to 705° C), and ammonia is introduced into the atmosphere in amounts such that the ammonia content ranges from about 1% to about 20% by volume. The treatment is carried out for a period of time sufficient to cause reaction of all the nitride forming elements in the stock with the nitrogen provided by the ammonia gas to form small, uniformly dispersed nitrides. The nitriding treatment is concluded by discontinuing the introduction of ammonia, which results in flushing it from the furnace naturally. The anneal is then continued in the form of a denitriding treatment in a hydrogen-nitrogen mixture containing about 6% to about 50% hydrogen by volume, within the temperature range of 1200° to 1400° F (649° to 760° C) for a period of time (generally equal to or shorter than the duration of the nitriding step) sufficient to remove the iron-nitride surface layer which has been formed on the stock. For good weldability, nitrogen in solid solution is reduced to less than about 0.03% by weight.

Alternatively, the cold rolled stock can be recrystallized, prior to strengthening, so that a high $r_m$ value is produced, by other procedures, such as tight coil annealing or strip (continuous) annealing. The strengthening treatment can be applied as a separate and distinct heat treatment at a later time by open coil annealing or any other form of annealing which permits free circulation of the nitridingdenitriding atmosphere over the surfaces of the stock. This procedure would involve two annealing cycles, one for recrystallization and one for strengthening, and would be less economical than that in which the stock is open coil annealed and in which the recrystallization step and the strengthening steps are incorporated in the same annealing cycle.

Unlike the process of the above-mentioned U.S. Pat. No. 3,847,682, wherein alloy-nitrogen precipitation strengthening is conducted in such manner as to avoid the formation of an iron-nitride surface layer, the present invention effects strengthening by nitriding under conditions such that an iron nitride surface layer is formed which is then removed by a denitriding step, which consists of annealing in a hydrogennitrogen mixture wherein the hydrogen content does not exceed 50% by volume.

The use of hydrogen-nitrogen mixtures in which nitrogen predominates as a carrier gas for ammonia during the nitriding process, and the discovery that denitriding can be successfully carried out in hydrogen-nitrogen mixtures in which nitrogen predominates, provides a process which is safer, more economical, faster and commercially more feasible than prior art processes.

DESCRIPTION OF THE PREFERRED EMBODIMENTS

A preferred composition for carrying out the method of the present invention is as follows, in weight percent:

| | |
|---|---|
| carbon | less than about 0.010% |
| nitrogen | up to about 0.004% |
| aluminum | about 0.02% to 0.06% (total) |
| manganese | about 0.05% to about 0.6% |
| sulfur | up to about 0.035% |
| oxygen | up to about 0.01% |
| phosphorus | residual (up to 0.01%) |
| silicon | residual (up to 0.015%) |
| titanium | about 0.05% to 0.15% (total) |
| at least one of | |
| columbium | about 0.03% to 0.06% (total) |
| and | |
| zirconium | about 0.03% to 0.06% (total) |
| iron | remainder, except for incidental impurities. |

As in the case of the broad composition set forth above, the titanium content is such that at least about 0.02% by weight is present in solution, and at least about 0.025% by weight of columbium and/or zirconium is present in solution prior to nitriding, with the sum total of these three elements not exceeding about 0.3% in solution.

In the preferred practice of the process of the invention, the nitriding step is conducted in an atmosphere containing about 3% to 5% by volume ammonia in a carrier gas comprising 15% hydrogen and 85% nitrogen by volume at a temperature of about 1150° to 1250° F (about 711° to 677° C) for a period of time, dependent on thickness of the strip or sheet or articles, sufficient to convert the nitride-forming alloying elements to their nitrides. By way of example, for stock or articles of 0.06 inch thickness the required nitriding time would be between 3 and 4 hours. For other thicknesses the time is proportional to the square of the thickness. Upon completion of the nitriding step, the introduction of ammonia into the furnace atmosphere is discontinued, and the anneal is continued in an atmosphere preferably containing 15% to 20% by volume hydrogen, balance nitrogen, while the temperature is raised preferably to about 705° C, the anneal being continued for a period of time sufficient to remove the iron nitride surface layer and to reduce the level of nitrogen in solid solution to less than 0.03%.

A steel falling within the preferred composition limits set forth above was cast, hot rolled, cold rolled to 0.06 inch thickness and annealed in accordance with the process of the present invention. Table I sets forth the composition of the cold rolled sheet stock and tensile properties after recrystallization but before the nitriding heat treatment. After nitriding, which was carried out in such manner that all the nitride-forming elements titanium, columbium and aluminum, combined completely with the nitrogen introduced by addition of ammonium to the annealing atmosphere, the steel had a theoretical nitrogen content of 0.0623% by weight, as calculated by the formula:

$$\%N^{\text{combined as}}_{\text{alloy nitrides}} = \frac{\%\,Cb}{6.65} + \frac{\%Ti - 4 \times \%C}{3.43} + \frac{\%Al}{1.93} + \frac{\%Zr}{6.51} \qquad (1)$$

Substituting the percentages of the various elements set forth in Table I in formula (1) provides the following result:

$$\%N = \frac{0.056}{6.65} + \frac{0.13 - 4 \times 0.008}{3.43} + \frac{0.049}{1.93} + 0 = 0.0623$$

A total actual nitrogen content of the steel after nitriding in excess of 0.0623% represents nitrogen in solid solution and as iron-nitrides, and such excess nitrogen can be substantially completely removed by denitriding without removing any of the nitrogen combined as alloy nitrides.

Sheet samples of the steel of Table I were nitrided in a manner which would be used to strengthen articles in an atmosphere containing 3% ammonia in a carrier gas of 15% hydrogen and 85% nitrogen at 1200° F for 4 hours. These sheet samples exhibited a Rockwell C hardness of 32 and contained 0.11% by weight nitrogen. These samples had a surface layer of iron nitride and were quite brittle, exhibiting no bend ductility. In this condition an article strengthened after forming would be of no utility since it would be non-weldable and brittle. Similarly, a strengthened sheet stock in this condition would have no utility since it could not be formed into an article by stamping or drawing because of its brittleness.

For purposes of comparison nitrided sheet samples were annealed in accordance with prior art denitriding methods at 1200° F in an atmosphere of 100% hydrogen and by the method of the present invention in an atmosphere of 20% hydrogen and 80% nitrogen by volume at 1200°, 1300° and 1400° F. These results are summarized in Table II. It will be evident from inspection of the data of Table II that annealing for six hours in 100% hydrogen at 1200° F resulted in almost as complete denitriding as was obtained by annealing for 20 hours. After 20 hours the nitrogen content decreased from 0.11% to 0.064%, which was in excellent agreement with the theoretical combined nitrogen content of 0.0623% as calculated by Formula (1). Removal of the brittle iron nitride surface layer and substantially complete removal of excess nitrogen in solid solution rendered the steel ductile and weldable.

By way of comparison, samples which where denitrided in accordance with the process of the present invention exhibited a decrease in hardness comparable to that obtained in 100% hydrogen. The extent of denitriding was greater at 1300° and 1400° F than at 1200° F. The brittle iron nitride surface layers were eliminated, and the sheet samples were successfully bent over a 0.380 inch diameter punch indicating a maximum fiber tensile elongation at 13.6%. More severe bends probably could have been tolerated. Excess nitrogen contents (above the theoretical level of 0.0623%, or the 0.064% measured level) of the samples denitrided in the 20% hydrogen atmosphere were sufficiently low that weldability would not be impaired.

It will be noted that the yield strength levels developed in the steel of Tables I and II, under the described treatments, all exceeded 90 ksi. Such strength levels would undoubtedly be of greatest interest to a commercial producer of formed articles. However, it is within the scope of the invention to produce lower strength levels, if desired (e.g. an average yield strength of about 50 ksi or higher), by suitable adjustment of the steel composition and treatment, viz., lower alloying contents and higher strengthening treatment temperature.

Thus, according to the present invention, a cold reduced and annealed strip or sheet stock, and a deep drawn or stamped article formed therefrom having a yield strength of at least 50 ksi, consists essentially of the compositions set forth above, and sufficient nitrogen to combine substantially completely with aluminum, titanium, columbium and zirconium, as calculated by formula (1) above.

TABLE I

CHEMICAL COMPOSITION-PERCENT BY WEIGHT AND TENSILE PROPERTIES OF UNTREATED STEEL SHEET

| Cb | Ti | Al | C | N | Mn | S | P | Si | Fe |
|---|---|---|---|---|---|---|---|---|---|
| 0.056 | 0.13 | 0.049 | 0.008 | 0.004 | 0.29 | 0.012 | 0.008 | 0.011 | balance |

| Yield Strength-psi | Tensile Strength-psi | Percent Elong. in 2in. | Plastic Strain Ratios r-0° | r-45° | 4-90° | rm* |
|---|---|---|---|---|---|---|
| 18,650 | 45,950 | 48 | 2.00 | 1.70 | 2.47 | 1.97 |

* $r_m = \frac{1}{4}(r\text{-}0° + r\text{-}90° + 2r\text{-}45°)$

TABLE II

PROPERTIES & NITROGEN CONTENT AFTER NITRIDING & DENITRIDING

| Condition | Gas Composition %$NH_3$ | %$H_2$ | %$N_2$ | Temp. °F | Time Hrs. | %$N_2$ in Steel | Hardness Rc Scale | Yield Strength* ksi | Bend Test** Result |
|---|---|---|---|---|---|---|---|---|---|
| As-nitrided | 3 in(15 + 85) | | | 1200 | 4 | 0.11 | 32 | 123 | Failed |
| Denitrided | 100 | | | 1200 | 6 | 0.068 | 23 | 95 | Passed |
| Denitrided | 100 | | | 1200 | 20 | 0.064 | 22 | 93 | Passed |
| Denitrided | 20 | 80 | | 1200 | 3 | 0.086 | 29 | 112 | Passed |
| Denitrided | 20 | 80 | | 1300 | 3 | 0.076 | 27 | 104 | Passed |
| Denitrided | 20 | 80 | | 1400 | 3 | 0.078 | 23 | 95 | Passed |

*Based on tensile property data on strengthened samples of this steel covering this range of hardness, but not these particular samples.
**0.060 inch thick by one inch wide strips bent over 0.380 inch diameter mandrel.

Table III shows the effect of a denitriding atmosphere composition ranging from 100% nitrogen through various hydrogen-nitrogen mixtures to 100% hydrogen, with denitriding conducted at the preferred temperature of 1300° F. It is evident that as little as 6% hydrogen by volume resulted in removal of the iron-nitride surface layer and restoration of bend ductility. Weldability, however, was not acceptable since the level of excess nitrogen in solid solution (0.125%–0.064%= 0.061%) was not sufficiently reduced to eliminate objectionable weld porosity. Equilibrium considerations indicate that if denitriding had been continued for a period of time longer than three hours in 6% hydrogen, a further reduction in nitrogen in solid solution would have occurred (to less than about 0.03%), resulting in satisfactory weldability. Hydrogen contents from 15% to 50% by volume resulted in substantial decreases in excess nitrogen levels leading to restoration of ductility and satisfactory weldability, thus demonstrating the effectiveness of denitriding in an atmosphere containing no more than 50% hydrogen.

TABLE III

EFFECT OF DENITRIDING ATMOSPHERE COMPOSITION AND PROPERTIES AFTER NITRIDING AND DENITRIDING COMPOSITION OF TABLE I

| Condition | Gas Composition %$NH_3$ | %$H_2$ | %$N_2$ | Temp. °F | Time hrs. | %$N_2$ in Steel | No. of Points Decrease in Hardness RC Scale | Presence of Surface Iron-Nitrides | Bend Test Results-6T Bend | Visible Outgassing During TIG Welding | Degree of Weld Porosity in Fusion Zone |
|---|---|---|---|---|---|---|---|---|---|---|---|
| As nitrided | 3 in (15 + 85) | | | 1200 | 4 | 0.166 | 0 | Surface layer present | Failed Brittlely | high | high |
| Denitrided | | | 100 | 1300 | 3 | 0.143 | 0 | surface-layer slightly reduced | Failed Brittlely | high | high |
| Denitrided | 6 | 94 | | 1300 | 3 | 0.125 | 1 | None | Passed | high | high |
| Denitrided | 15 | 85 | | 1300 | 3 | 0.097 | 2.7 | None | Passed | slight | negligible |
| Denitrided | 20 | 80 | | 1300 | 3 | 0.095 | 2.7 | None | Passed | slight | negligible |
| Denitride | 50 | 50 | | 1300 | 3 | 0.081 | 5.3 | None | Passed | none | negligible |
| Denitrided | 100 | | | 1300 | 3 | 0.071 | 5.5 | None | Passed | none | none |

TABLE IV

CHEMICAL COMPOSITIONPERCENT BY WEIGHT OF AS-RECRYSTALLIZED 0.034 INCH THICK STEEL SHEET

| Cb | Ti | Al | C | N | Mn | S | P | Si | Fe |
|---|---|---|---|---|---|---|---|---|---|
| 0.058 | 0.12 | 0.049 | 0.008 | 0.006 | 0.29 | 0.012 | 0.008 | 0.011 | balance |

PROPERTIES OF 0.034 INCH THICK SHEET AS-RECRYSTALLIZED AND AFTER ALLOY-NITRIDE STRENGTHENING

| Condition | Yield Stength-psi | Tensile Strength-psi | Percent Elong. in 2 inches | Plastic Strain Ratios r-0° | r-45° | 4-90° | $r_m$ |
|---|---|---|---|---|---|---|---|
| As Recrystallized | 20,300 | 47,200 | 45 | 1.67 | 1.90 | 2.40 | 1.97 |
| Strengthened-1300° F(1) | 68,300 | 81,200 | 16 | 1.72 | 1.80 | 2.30 | 1.91 |
| Strengthened-1200° F(2) | 91,400 | 102,800 | 12 | | | | |

(1)Nitrided 1300° F-1hr in 3% ammonia in 15% hydrogen + 85% nitrogen; denitrided 1300° F-2hr in 20% hydrogen + 80% nitrogen
(2)Nitrided 1200° F-1hr in 3% ammonia in 15% hydrogen + 85% nitrogen; denitrided 1200° F-3hr in 20% hydrogen + 80% nitrogen A 0.034 inch thick sheet stock was strengthened in accordance with the present invention. Table IV sets forth the composition of the stock before strengthening, the properties before and after strengthening, and the processing conditions. The results illustrate the simultaneous attainment of both high strength and very high $r_m$ values, as applied to strip and sheet stock wherein the process of the present invention develops high $r_m$ values by the recrystallization step, and high strength is subsequently developed by the alloynitrogen strengthening step.

The present invention thus provides a cold reduced and annealed strip or sheet stock having a thickness between about 0.02 and 0.09 inch, strengthened by alloy-nitrogen precipitation strengthening to an average yield strength of at least about 50 ksi, an average plastic strain ratio ($r_m$) of 1.8 to 2.2, and good formability, consisting essentially of the broad or preferred compositions set forth above, and sufficient nitrogen to combine substantially completely with the aluminum, titanium, columbium and zirconium, as calculated by formula (1) above. For good weldability the stock is denitrided in an atmosphere containing about 6% to 50% hydrogen by volume to reduce nitrogen in solid solution to less than about 0.03%. Under any treatment conditions of the invention the final product is free from an iron nitride surface layer and has sufficient formability to pass a 6T bend test.

The invention further provides a deep drawn or stamped article formed from a cold reduced and fully recrystallized strip or sheet stock, said article having an average yield strength of at least about 50 ksi after strengthening, good weldability and residual ductility, consisting essentially of the broad or preferred compositions set forth above, and sufficient nitrogen to combine substantially completely with aluminum, titanium, columbium and zirconium, as calculated by formula (1) above.

The embodiments of the invention in which an exclusive property or privilege is claimed are defined as follows:

1. A method of increasing the yield strength of a low carbon steel sheet stock, which comprises:

providing a deoxidized, deep drawing quality steel containing, by weight percent, from about 0.002% to about 0.015% carbon, up to about 0.012% nitrogen, up to about 0.08% aluminum, about 0.05% to about 0.6% manganese, up to about 0.035% sulfur, up to about 0.01% oxygen, up to about 0.01% phosphorus, up to about 0.015% silicon, a nitride-forming element chosen from the group consisting of titanium, columbium, zirconium, and mixtures thereof, in amounts such that titanium in solution is from about 0.02% to about 0.2%, columbium in solution is from about 0.025% to about 0.3%, and zirconium in solution is from about 0.025% to about 0.3%, the sum total of said nitride-forming elements not exceeding about 0.3% in solution, and balance iron except for incidental impurities;

reducing said steel to a final thickness of about 0.02 to about 0.09 inch;

annealing said steel at about 705° to about 760° C in an atmosphere consisting essentially of about 6% to 20% by volume hydrogen and remainder essentially nitrogen for a period of time sufficient to produce complete recrystallization;

annealing the resulting sheet stock in an atmosphere consisting essentially of about 1% to about 20% by volume ammonia and remainder a carrier gas of nitrogen and hydrogen in which hydrogen is 6% to 20% by volume and remainder essentially nitrogen at a temperature between 593° and 705° C for a period of time of at least 3 hours and sufficient to cause reaction of said nitrideforming elements with the nitrogen of said ammonia to form small, uniformly dispersed nitrides and to cause formation of a surface layer of iron nitride; and denitriding said sheet stock in an atmosphere consisting essentially of about 6% to about 50% by volume hydrogen and balance essentially nitrogen within the temperature range of 649° to 760° C for a period of time equal to or less than that of the nitriding annealing step whereby to remove the iron nitride surface layer.

2. The method of claim 1, wherein said denitriding step is conducted for a period of time sufficient to reduce nitrogen in solid solution to less than about 0.03% by weight.

3. The method of claim 1, wherein said steel initially consists essentially of less than about 0.010% carbon, up to about 0.004% nitrogen, about 0.02% to about 0.06% aluminum, about 0.05% to about 0.6% manganese, up to about 0.035% sulfur, up to about 0.01% oxygen, residual phosphorus and silicon, about 0.05% to about 0.15% total titanium, from about 0.03% to about 0.06% total of an element chosen from the group consisting of columbium, zirconium, and mixtures thereof, and balance iron except for incidental impurities.

4. The method of claim 1, wherein the step of annealing to product complete recrystallization comprises open coil annealing, tight coil annealing, or continuous annealing.

5. The method of claim 1, wherein said sheet stock is cold rolled to final thickness, and wherein the yield strength of said sheet stock is increased to at least about 50 ksi and the average plastic strain ratio ($r_m$) to at least about 1.8.

6. The method of claim 2, wherein said sheet stock is nitrided in an atmosphere consisting essentially of about 3% to about 5% by volume ammonia, about 15% hydrogen and about 85% nitrogen by volume, at a temperature of about 611° to about 677° C, and wherein said sheet stock is denitrided in an atmosphere consisting essentially of about 15% to 20% by volume hydrogen and balance nitrogen at a temperature of about 705° C.

7. A method of increasing the yield strength of an article formed from a low carbon steel sheet stock of deep drawing quality, which comprises:

providing a steel containing, by weight percent, from about 0.002% to about 0.015% carbon, up to about 0.012% nitrogen, up to about 0.08% aluminum, about 0.05% to 0.6% manganese, up to about 0.035% sulfur, up to about 0.01% oxygen, up to about 0.01% phosphorus, up to about 0.015% silicon, a nitride-forming element chosen from the group consisting of titanium, columbium, zirconium, and mixtures thereof, in amounts such that titanium in solution is from about 0.02% to about 0.2%, columbium in solution is from about 0.025% to about 0.3%, and zirconium in solution is from about 0.025% to about 0.3%, the sum total of said nitride-forming elements not exceeding about 0.3% in solution and balance iron except for incidental impurities;

reducing said steel to a final thickness of about 0.02 to about 0.09 inch;

annealing at about 705° to about 760° in an atmosphere consisting essentially of 6% to 20% by volume hydrogen and remainder essentially nitrogen for a period of time sufficient to obtain a fully recrystallized, ductile, deep-drawing sheet stock;

forming said article from said annealed sheet stock;

heating said article in an atmosphere consisting essentially of about 1% to about 20% by volume ammonia and remainder a carrier gas of nitrogen and hydrogen in which hydrogen is 6% to 20% by volume and remainder essentially nitrogen at a temperature between 593° and 705° C for a period of time of at least 3 hours and sufficient to cause reaction of said nitride forming elements with the nitrogen of said ammonia to form small, uniformly dispersed nitrides and to cause formation of a surface layer of iron nitride; and denitriding said article in an atmosphere consisting essentially of about 6% to about 50% by volume hydrogen and balance essentially nitrogen within the temperature range of 649° to 760° C for a period of time equal to or less than that of the nitriding heating step whereby to remove the iron nitride surface layer.

8. The method of claim 7, wherein said steel initially consists essentially of less than about 0.010% carbon, up to about 0.004% nitrogen, about 0.02% to about 0.06% aluminum, about 0.05% to about 0.06% manganese, up to about 0.035% sulfur, up to about 0.01% oxygen, residual phosphorus and silicon, about 0.05% about 0.15% total titanium, from about 0.03% to about 0.06% total of an element chosen from the group consisting of columbium, zirconium, and mixtures thereof, and balance iron except for incidental impurities.

9. The method of claim 7, wherein said article is nitrided in an atmosphere consisting essentially of about 3% to 5% by volume ammonia, about 15% hydrogen and 85% nitrogen by volume, at a temperature of about 611° to about 677° C, and wherein said article is denitrided in an atmosphere consisting essentially of about 15% to 20% by volume hydrogen, and balance essentially nitrogen at a temperature of about 705° C for a period of time sufficient to reduce nitrogen in solid solution to less than about 0.03% by weight.

10. Cold reduced and annealed steel strip and sheet stock having a thickness between about 0.02 and 0.09 inch (0.51 and 2.29 mm), an average yield strength of at least about 50 ksi, a plastic strain ratio ($r_m$) of 1.8 to 2.2, good weldability and formability, consisting essentially of, by weight percent, less than about 0.010% carbon; about 0.02% to 0.06% aluminum; about 0.05% to about 0.6% manganese; up to about 0.035% sulfur; up to about 0.01% oxygen; residual phosphorus and silicon; about 0.05% to 0.15% total titanium; about 0.03% to about 0.06% of an element chosen from the group consisting of columbium, zirconium, and mixtures thereof; sufficient nitrogen to combine substantially completely with said aluminum, titanium, columbium, and zirconium, as calculated by the formula $$\%\text{N combined} = \frac{\%\text{Cb}}{6.65} + \frac{\%\text{Ti} - 4 \times \%\text{C}}{3.43} + \frac{\%\text{Al}}{1.93} + \frac{\%\text{Zr}}{6.51};$$

and remainder iron except for incidental impurities said sheet stock having been produced by the method of claim 1.

11. A deep-drawn or stamped article having an average yield strength of at least about 50 ksi, good weldability and residual ductility, formed from a cold reduced and fully recrystallized steel strip or sheet stock consisting essentially of, by weight percent, less than about 0.010% carbon; about 0.02% to 0.06% aluminum; about 0.05% to about 0.6% manganese; up to about 0.035% sulfur; up to about 0.01% oxygen; residual phosphorus and silicon; about 0.05% to 0.15% total titanium; about 0.03% to about 0.06% of an element chosen from the group consisting of columbium, zirconium, and mixtures thereof; sufficient nitrogen to combine substantially completely with said aluminum, titanium, columbium and zirconium, as calculated by the formula $$\%\text{N combined} = \frac{\%\text{Cb}}{6.65} + \frac{\%\text{Ti} - 4 \times \%\text{C}}{3.43} + \frac{\%\text{Al}}{1.93} + \frac{\%\text{Zr}}{6.51};$$

and remainder iron except for incidental impurities said recrystallized sheet stock having been produced by the method of claim 7.

* * * * *